United States Patent [19]

Morel et al.

[11] 4,090,930

[45] May 23, 1978

[54] METHOD OF AND AN APPARATUS FOR COMPENSATING THE MAGNETIC FIELDS OF ADJACENT ROWS OF TRANSVERSELY ARRANGED IGNEOUS ELECTROLYSIS CELLS

[75] Inventors: Paul Morel, Le Vesinet; Jean-Pierre Dugois, Saint Jean-de-Maurienne, both of France

[73] Assignee: Aluminum Pechiney, Lyon, France

[21] Appl. No.: 774,392

[22] Filed: Mar. 4, 1977

[30] Foreign Application Priority Data

Aug. 3, 1976 France ..... 76 07404

[51] Int. Cl.[2] ..... C25C 3/06; C25C 3/16

[52] U.S. Cl. ..... 204/67; 204/243 M; 204/244

[58] Field of Search ..... 204/243 M, 244, 243 R, 204/246–247, 67

[56] References Cited

U.S. PATENT DOCUMENTS

| | | | |
|---|---|---|---|
| 3,616,317 | 10/1971 | McLellan et al. | 204/244 X |
| 3,617,454 | 11/1971 | Johnson | 204/244 X |
| 3,719,577 | 3/1973 | Robl et al. | 204/244 X |
| 3,969,213 | 7/1976 | Yamamoto et al. | 204/243 M X |

*Primary Examiner*—G. L. Kaplan
*Assistant Examiner*—D. R. Valentine
*Attorney, Agent, or Firm*—McDougall, Hersh & Scott

[57] ABSTRACT

A method of compensating the magnetic fields of adjacent rows of transversely arranged igneous electrolysis cells, in which the distribution of the current in the conductors feeding the anode of a downstream cell from the cathode of the adjacent upstream cell is modified so as to superimpose upon the cell an electrical loop which produces an additional magnetic field substantially equal to that created by the adjacent row and opposite to it in direction, wherein the electrical loop develops its compensating effect solely on the outer head of the electrolysis cell.

8 Claims, 4 Drawing Figures

METHOD OF AND AN APPARATUS FOR COMPENSATING THE MAGNETIC FIELDS OF ADJACENT ROWS OF TRANSVERSELY ARRANGED IGNEOUS ELECTROLYSIS CELLS

This invention, which is the outcome of work by Messrs. Paul MOREL and Jean-Pierre DUGOIS, relates to an improvement in the "method of and apparatus for compensating the magnetic fields of adjacent rows of transversely arranged igneous electrolysis cells" which was the subject of our patent application Ser. No. 670,898, filed Mar. 26, 1976 now U.S. Pat. No. 4,049,528.

Aluminum is commercially produced by the igneous electrolysis, in cells electrically connected in series of a solution of alumina in cryolite heated to a temperature of the order of 950° to 1000° C by the Joule effect of the current flowing through the cell.

Each cell comprises a rectangular cathode forming a crucible, of which the base is formed by blocks of carbon secured to steel bars, so-called cathode bars, which are used to remove the current from the cathode towards the anodes of the following cell.

The anodes, also made of carbon, are secured to rods anchored to aluminum bars, so-called anode bars, fixed to a superstructure which overhangs the crucible of the cell. These anode bars are connected by aluminum conductors, so-called "steps", to the cathode bars of the preceding cell.

The electrolysis bath, i.e. the solution of alumina in cryolite, is situated between the anodes and the cathode. The aluminum produced is deposited onto the cathode, a reserve of aluminum being kept at the base of the cathode crucible.

Since the crucible is rectangular, the anode bars supporting the anodes are in general parallel to its large sides, while the cathode bars are parallel to its small sides, so-called cell heads.

The cells are arranged in rows either longitudinally or transversely, depending on whether their large side or their small side is parallel to the axis of the row. The cells are electrically connected in series, the ends of the series being connected to the positive and negative outputs of an electrical substation for rectification and regulation. Each series of cells comprises a certain number of rows connected in series, the number of rows perferably being even so as to avoid unnecessary lengths of conductors.

The electrical current which flows through the various conductors: electrolyte, liquid metal, anodes, cathode, connecting conductors, creates considerable magnetic fields. Both in the electrolysis bath and in the molten metal accommodated in the crucible, these fields induce so-called Laplace forces which, on account of the movements which they generate, are harmful to the operation of the cell. The cell and its connecting conductors are designed in such a way that the magnetic fields created by the various parts of the cell and the connecting conductors compensate one another. Accordingly, the overall result is a cell having, as its plane of symmetry, the vertical plane running parallel to the row of cells and passing through the center of the crucible.

However, the cells are also subjected to troublesome magnetic fields emanating from the adjacent row or rows.

Hereinafter, the words "upstream" and "downstream" are related to the general direction of the electrical current flowing through the row of cells in question. The "adjacent row" is the row closest to the row in question, while the "field of the adjacent row" is the resultant of the fields of all the rows other than the row in question.

In our patent application Ser. No. 670,898, we described a method of and an apparatus for compensating the magnetic fields of adjacent rows of transversely arranged igenous electrolysis cells, in which the distribution of electrical current in the conductors feeding the anode of a downstream cell from the cathode of the adjacent upstream cell is modified in such a way as to superimpose upon the cell an electrical loop which produces an additional magnetic field substantially equal to that created by the adjacent row and opposite to it in direction.

Each cell comprises at least two anode bars, to which rods secured to the anodes are fixed, and a cathode crucible of which the base is formed by blocks of carbon sealed to cathode bars, the anode bars of the downstream cell being supplied with electrical current from the cathode bars of the upstream cell by at least two steps, namely an inner step, i.e. situated on the side of the adjacent row, and an outer step, each step comprising two conductors of which one is connected to the upstream ends of the cathode bars while the other is connected to the downstream ends of the cathode bars. One of the conductors of the inner step, on the upstream side or downstream side, is connected to more than half the corresponding ends of the cathode bars, taken from the inside, the corresponding conductor of the outer step being connected to the outside ends which are not connected to the inner step, while the other inner conductor on the downstream or upstream side is connected to the inner half of the corresponding ends and the outer conductor corresponding to half the outside.

It is easy to determine the intensity of the current to be diverted from the outer conductor to the inner conductor to create an electrical loop producing an additional positive vertical field with substantially the same intensity as the negative vertical field created by the adjacent row, because the field is proportional to the intensity of the current. Thus, by superimposing the intensities, the corresponding fields are superimposed.

Accordingly, calculation of the intensity to be diverted consists in calculating or measuring the field created by the loop defined above in dependence upon the intensity I of the diverted current which flows through it, subsequently superimposing this field upon that of the noncompensated cell and finally varying I until the maximum vertical field of the cell is as weak as possible in terms of absolute value.

In practice, the value of the vertical field at the four corners of the cell is calculated or measured and recorded on a graph as a function of I, and the value of $I_o$ of I corresponding to the absolute value of the minimum of the maximum vertical field is directly read off. The electrical connection is then established by connecting a certain number of cathode bars to each circuit so that the intensity I is as close as possible to $I_o$.

However, it has been found during application of the method and apparatus which have just been described that the influence of the adjacent row is favorable on the inside of the cell, because it creates a field of opposite sign to the cell's own field, but is unfavorable on the outside of the cell where it creates a field which is added to the cell's own field.

The invention will be described with reference to the accompanying drawings which are given by way of illustration but not by way of limitation in which.

According to the present invention, the field of the adjacent row is only compensated on the outside of the cell. To this end, the electrical compensation loop does not completely surround the cell, but instead remains localized below the outer head.

An apparatus for carrying out this method consists in diverting part of the current of the outer upstream conductor so that it passes below the cell, rather than towards the inside, this current rejoining the outer upstream conductor after having passed below the cell.

The position of this conductor which will be referred to hereinafter as the "compensation conductor" should be such that the magnetic field which it creates is maximal at that point of the cell where the vertical magnetic field to be compensated is at its most intense, i.e. in the vicinity of the outer angle of the anode. The compensation collector should be positioned as far as possible below the base of the cell. In order to determine its position in the horizontal plane, the value of the vertical magnetic field created by a horizontal conductor, which is assumed to be infinite to simplify calculation, is calculated at a point M situated at a distance $h$ above that plane.

Figure 1:
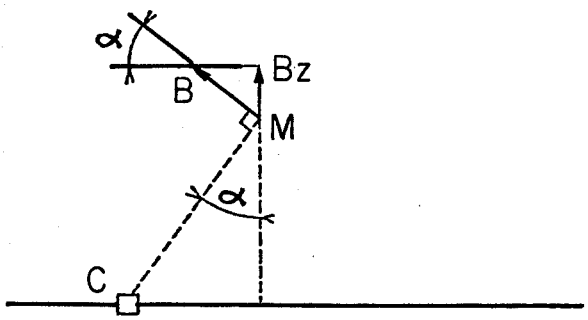
FIG. 1 is a diagram of the factors existing within an electrolytic cell.

In FIG. 1, C represents the cross-section of the compensation conductor as seen end-on, while M is the point where the magnetic field to be compensated (produced by the adjacent row) is at its most intense. $\alpha$ is the angle which the plane containing the compensation conductor C and the point M forms with the vertical. If I is the intensity of the current in the conductor C, the value of the magnetic field B at the point M is:

$$B = 2\, I/h \cos \alpha$$

If $B_z$ is the vertical component of the field at the point M, then:

$$B_z = B.\ \sin \alpha = 1/h \times 2 \cos \alpha \sin \alpha = 1/h \sin 2\, \alpha$$

$B_z$ is maximal where $\sin 2\, \alpha = 1$ i.e. when $\alpha = 45°$.

Figure 2:
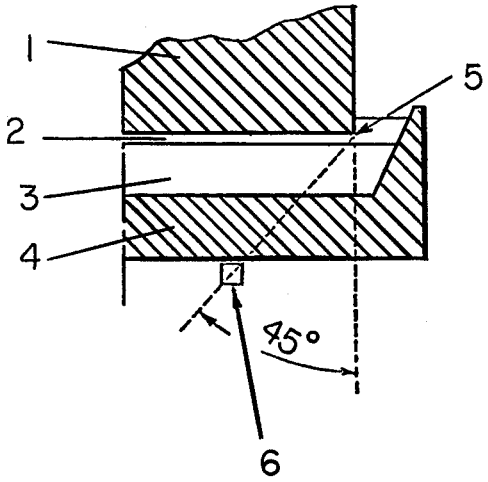
FIG. 2 is a diagrammatic, vertical, sectional view through the outer head of an electrolysis cell.

As can be seen from FIG. 2, the compensation conductor should therefore be positioned in such a way that the plane defined by the conductor and by the outer angle of the anode forms an angle substantially equal to 45° with the vertical.

In FIG. 2, which is a diagrammatic vertical section through the outer head of an electrolysis cell, the reference 1 denotes the anode, the reference 2 the molten electrolyte, the reference 3 the layer of liquid aluminum, the reference 4 the cathode block, the reference 5 the lower corner of the anode in the vicinity of which the vertical magnetic field to be compensated is maximal and the reference 6 the compensation conductor.

Figure 3:
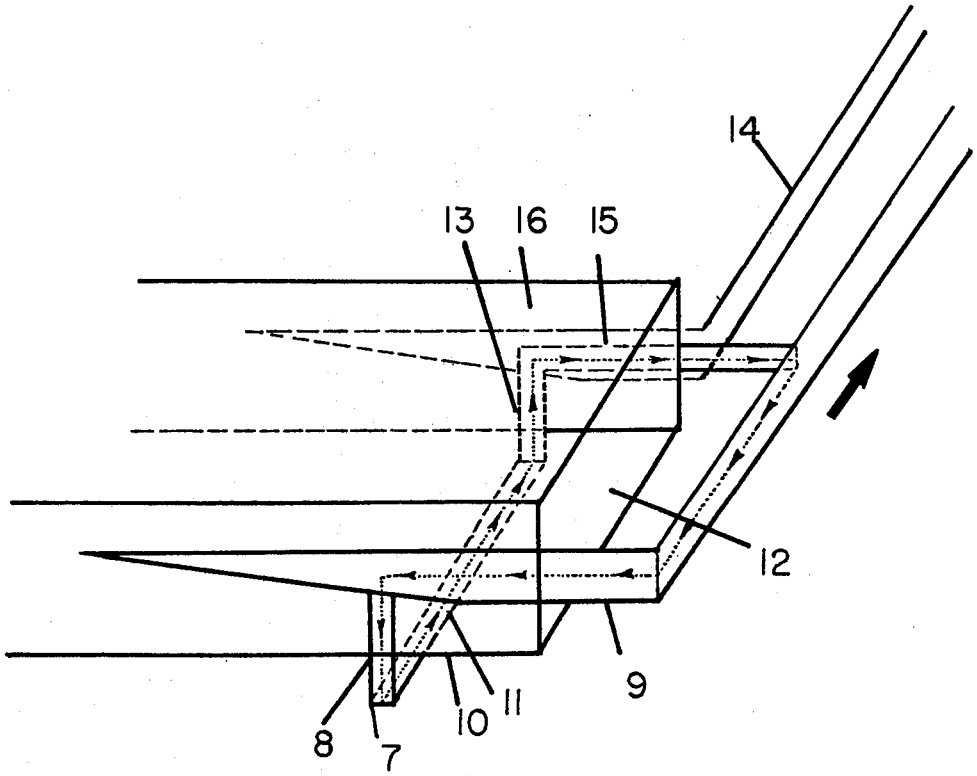
FIG. 3 is a perspective view of the outer head of an electrolysis cell.

FIG. 3, which is a diagrammatic perspective view of the outer head of an electrolysis cell, shows the precise position and path followed by the compensation conductor 7. It comprises a descent 8 from the outer upstream negative conductor 9 to the level of the base of the cell 10, a horizontal passage 11 below the cell parallel to its small side 12, an ascent 13 to the level of the outer downstream negative collector 14, and a return 15 parallel to the large side 16 of the cell for rejoining the upstream outer collector 9. The arrowed dotted line shows how the electrical loop generating the compensating field is formed.

Once the position of the compensation conductor has been defined, the intensity of the current which has to flow through the loop is determined in the same way as before by calculating the variation of the vertical field at the outer and inner upstream corners in dependence upon the intensity and by selecting the intensity for which these two values become equalized.

Figure 4:
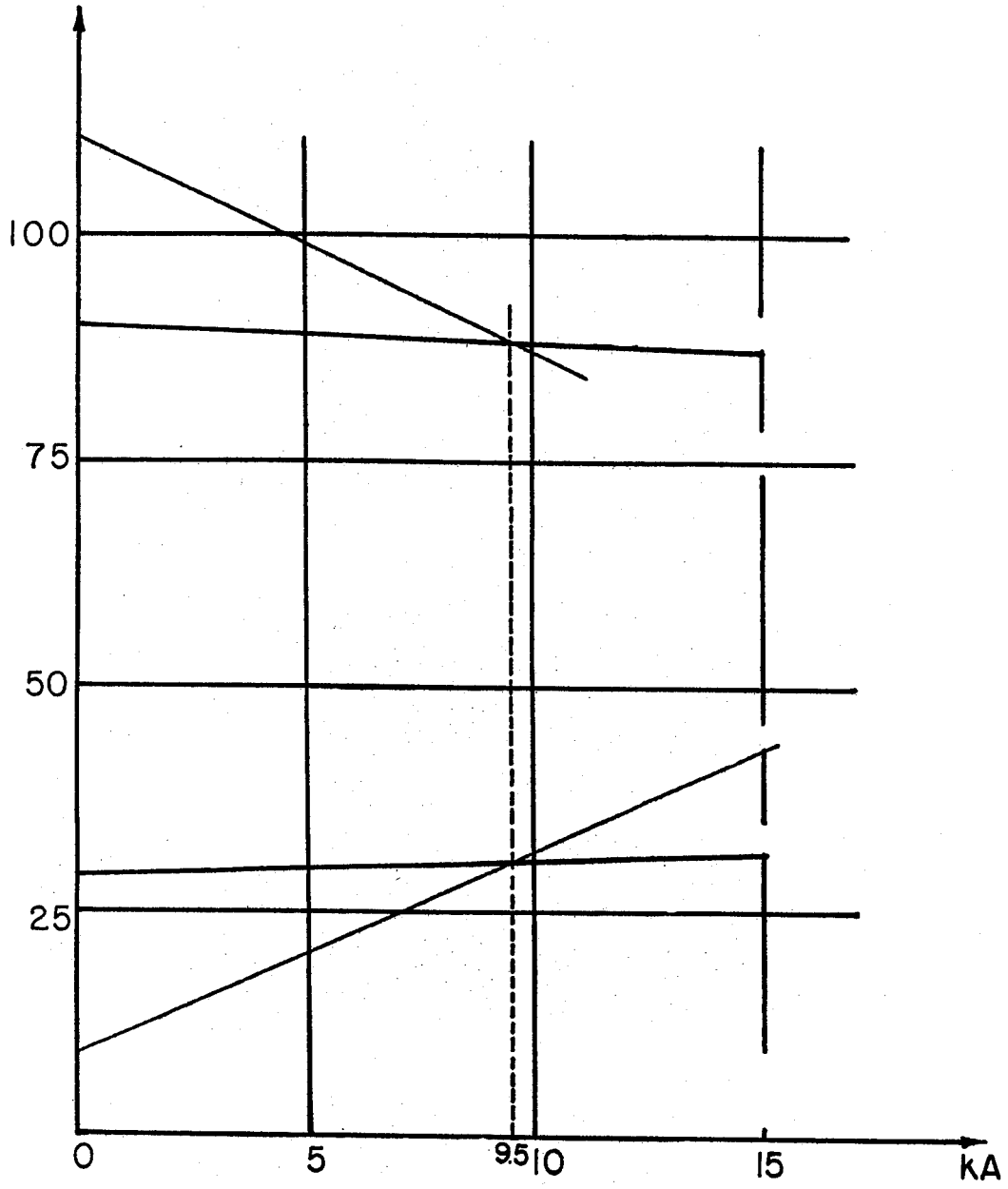
FIG. 4 is a graph which shows the manner of making the determinations of this invention.

The graph in FIG. 4 shows how this determination may be carried out for example in the case of a 90 kA electrolysis cell.

The intensity of the current in the compensation conductor is varied and this intensity value is recorded on the abscissa.

The value in gauss of the vertical magnetic field at the angles (inner upstream, outer upstream, inner downstream and outer downstream) is then measured and recorded on the ordinate. In addition, the field at the center of the cell is calculated.

It can be seen from the graph that the optimum value of the compensation current is slightly below 10 kA. By adopting 9.5 kA, the following values are obtained:

| Magnetic field in gauss (absolute values) | | Without compensation | With compensation conductor |
|---|---|---|---|
| Vertical | at the center | 8 | 14 |
| | inner upstream corner | 111 | 88.8 |
| | outer upstream corner | 90 | 88.5 |
| | inner downstream corner | 29 | 30.5 |
| | outer downstream corner | 9 | 30.5 |
| Horizontal | at the center | 0 | 2 (longitudinal) |

It can be seen that the horizontal field created by this method of compensation at the center has a zero transverse component and a very weak longitudinal component.

The method and apparatus according to the invention may be used both for cells comprising end steps and also for cells comprising central steps.

It will be understood that changes may be made in the details of construction and operation without departing from the spirit of the invention especially as defined in the following claims.

We claim:

1. A method of compensating the magnetic fields of adjacent rows of transversely arranged igneous electrolysis cells, in which the current to the anode of a downstream cell is fed from the cathode of the adjacent upstream cell comprising superimposing upon the cell an electrical loop which produces an additional magnetic field substantially equal to that created by the adjacent row and opposite to it by diverting a portion of the current from the upstream conductor from the cathode of the downstream cell, passing the diverted current below the cell and rejoining the diverted current with the outer upstream conductor after being passed below the cell.

2. The method as claimed in claim 1 which includes the steps of varying the fraction of the current diverted, measuring the value of the vertical field at the four corners of the cell, graphing the intensity of the current diverted against the value of the field in each corner of the cell, and selecting the intensity of the diverted current at the point where the magnetic field at the inner and outer upstream corner is substantially equal to that in the inner and outer downstream corner.

3. The method as claimed in claim 1 in which the amount of current diverted for passage below the cell is such that the magnetic field created is a maximum at the point of the cell where the vertical magnetic field to be compensated is most intense.

4. The method as claimed in claim 3 in which the vertical magnetic field to be concentrated is most intense in the vicinity of the outer angle of the anode.

5. An apparatus for compensating the magnetic fields of adjacent rows of transversely arranged igneous electrolysis cells connected in series for flow of electrical current from the cathode of one cell to the anode of an adjacent cell comprising an outer upstream negative collector, an outer downstream negative collector, a compensating conductor which extends below the cell from a downstream side to an upstream side, a connection between a downstream portion of a compensating conductor with a downstream portion of the outer upstream negative collector, a connection between an upstream portion of the compensating conductor and an upstream portion of the outer negative collector for passing a fraction of the current through the outer upstream negative collector to form a loop which rejoins the same upstream negative collector by passing along the major downstream side of the cell.

6. An apparatus as claimed in claim 5 in which the compensating conductor is positioned below the cell horizontally and parallel to the small sides of the cell and in such a way that the plane passing through the outer corner of the anode and the compensating cathode forms an angle substantially equal to 45° with the vertical.

7. An apparatus as claimed in claim 5 in which the cell is of rectangular shape having a side of minor dimension and a side of major dimension.

8. An apparatus as claimed in claim 7 in which the outer upstream negative conductor extends along the minor side of the cell and the outer downstream negative collector extends adjacent the major side of the cell.

* * * * *